United States Patent [19]

Isshiki et al.

[11] Patent Number: 4,469,934

[45] Date of Patent: Sep. 4, 1984

[54] ELECTRICALLY HEATED HAIR CURLING BRUSH WITH SELECTIVELY ROTATABLE HANDLE

[75] Inventors: Saburo Isshiki; Yoshinori Abura, both of Shiga, Japan

[73] Assignee: Matsushita Electric Works, Ltd., Osaka, Japan

[21] Appl. No.: 456,975

[22] Filed: Jan. 10, 1983

[30] Foreign Application Priority Data

Jan. 15, 1982 [JP] Japan ..... 57-5129

[51] Int. Cl.[3] ..... H05B 3/40; A45D 2/36; A46D 7/10

[52] U.S. Cl. ..... 219/222; 15/27; 132/11 R; 132/33 R; 132/34 R; 132/85; 132/118; 188/166; 219/230; 219/244

[58] Field of Search ..... 219/222–226, 219/244, 230; 188/166; 132/9, 11 R, 11 A, 33 R, 37 R, 37 A, 85, 118; 15/27

[56] References Cited

U.S. PATENT DOCUMENTS

| | | | |
|---|---|---|---|
| 3,890,984 | 6/1975 | Lesetar | 132/9 |
| 3,909,868 | 10/1975 | Nogues | 15/27 |
| 3,947,910 | 4/1976 | Akerman | 15/27 |
| 4,024,375 | 5/1977 | Olesen et al. | 219/225 |
| 4,029,110 | 6/1977 | Hyland | 219/222 X |
| 4,197,608 | 4/1980 | Holley et al. | 219/222 X |
| 4,314,137 | 2/1982 | Dorn | 219/222 |
| 4,326,545 | 4/1982 | Motegi et al. | 219/225 X |
| 4,329,567 | 5/1982 | Kunz et al. | 219/222 |

FOREIGN PATENT DOCUMENTS 2022406 12/1979 United Kingdom ..... 219/222

*Primary Examiner*—A. Bartis

*Attorney, Agent, or Firm*—Stevens, Davis, Miller & Mosher

[57] ABSTRACT

An electrically heated hair curling brush includes a generally cylindrical elongated handle having an elongated, thermally non-conductive brush support rotatably mounted within the handle and axially extending therefrom. An electric PTC heating element is housed within a brush cylinder non-rotatably mounted on the axially extending portion of the brush support. An elastically deformable elliptical locking ring within the handle surrounds the brush support and has a protrusion on the inner surface of each of its long sides engageable in recesses formed in the confronting surface of the brush support to lock the handle and brush support together so as to prevent relative rotation therebetween. A manually depressible button on one of the short sides of the locking ring projects through an opening in the handle. Selective manual depression of the button causes the long side of the locking ring to radially outwardly deflect thereby disengaging the projections from the recesses, and allowing rotation of the handle relative to the brush support. The lead wires for the heating element extend through the brush support to a connection block at the end of the support within the handle and are connected to a rotary connector thereon for rotary attachment to an electric power supply cord.

10 Claims, 9 Drawing Figures

ELECTRICALLY HEATED HAIR CURLING BRUSH WITH SELECTIVELY ROTATABLE HANDLE

BACKGROUND OF THE INVENTION

In conventional hair-curlers of this type, for example in U.S. Pat. No. 4,197,608 to Holly et al. issued Apr. 15, 1980, a heater is housed within a brush cylinder holding pipe which extends from a handle, and a brush cylinder is rotatably mounted like a sleeve around the brush cylinder holding pipe. Accordingly, not only is the brush cylinder holding pipe interposed between the brush cylinder and heater, but the radial distance between the inner circumferential surface of the brush cylinder and the confronting outer circumferential surface of the heater is so large as to inhibit the conduction of heat from the heater to the brush cylinder, leading to increased cost of operation or to a reduction of the hair-curling ability.

SUMMARY OF THE INVENTION

The present invention has been designed to overcome such difficulties in conventional devices as those described above, and its object is to provide a hair-curler which gives more efficient heat conduction from the heater to the brush cylinder, even though the brush cylinder is rotatably mounted.

The hair curler of this invention has an elongate body having a handle with a rotatable electric cord connection at one end and a bristled cylindrical curling surface at its other end. The handle is normally nonrotatably secured to the brush cylinder so that rotation of the handle about its own axis also rotates the brush cylinder. After the hair is wound around the brush cylinder to curl it, the hair may be unwound by releasing a locking mechanism so that the handle is free to rotate in relation to the brush cylinder.

BRIEF DESCRIPTION OF THE DRAWINGS

These and other objections are achieved by a prefered embodiment, described herein by way of example and not of limitation in which.

DESCRIPTION OF THE PREFERRED EMBODIMENTS

Figure 1:
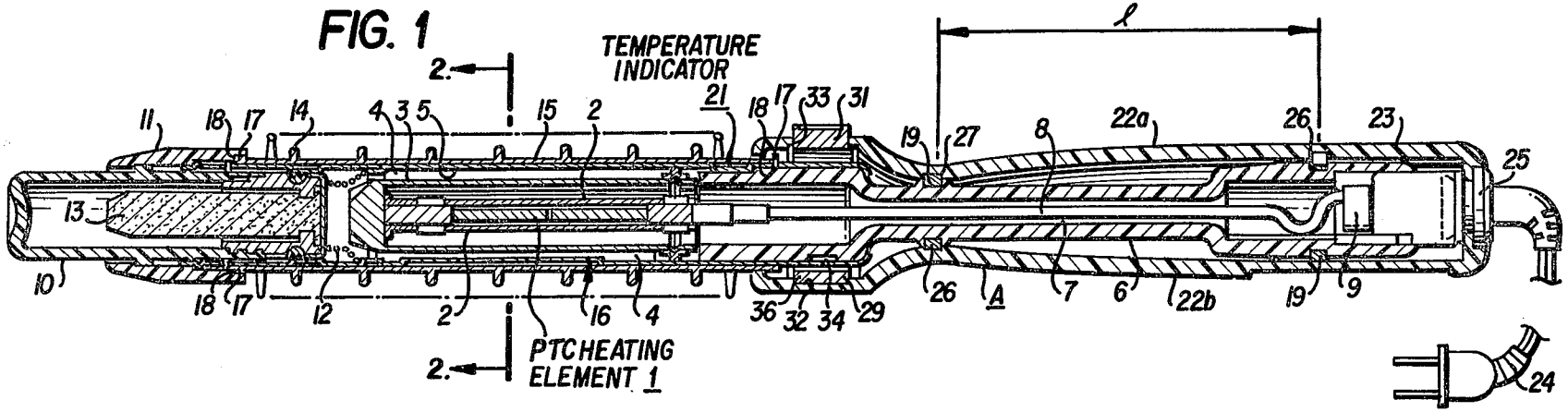
FIG. 1 is a longitudinal sectional view of an embodiment of this invention.

The present invention will now be described in detail with reference to the accompanying drawings, in which reference numeral 1 denotes a heater such as a PTC heater, for generating heat and, as shown in FIG. 1, heat sinks 2 are provided radially along side the heater 1, and are inserted into a sleeve 3 which is open at one end.

Figure 5A:
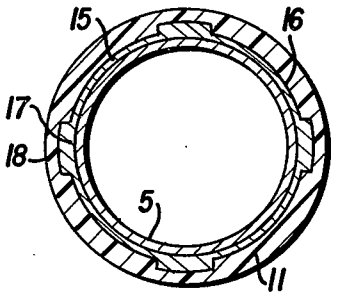
FIG. 5, (*a*), (*b*), and (*c*), show, respectively, sections taken along the lines 5*a*—5*a*, 5*b*—5*b*, and 5*c*—5*c* of FIG. 4.
Figure 5B:
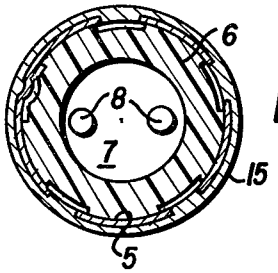
Figure 5C:
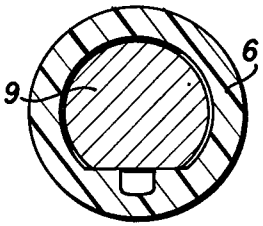
Figure 2:
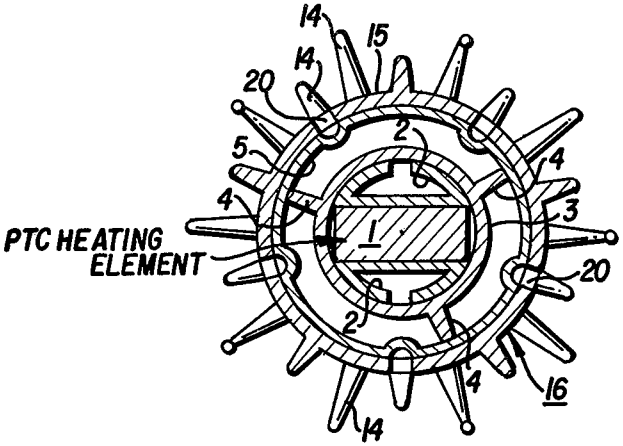
FIG. 2 is a sectional view taken along the line 2—2 of FIG. 1.
Figure 3:
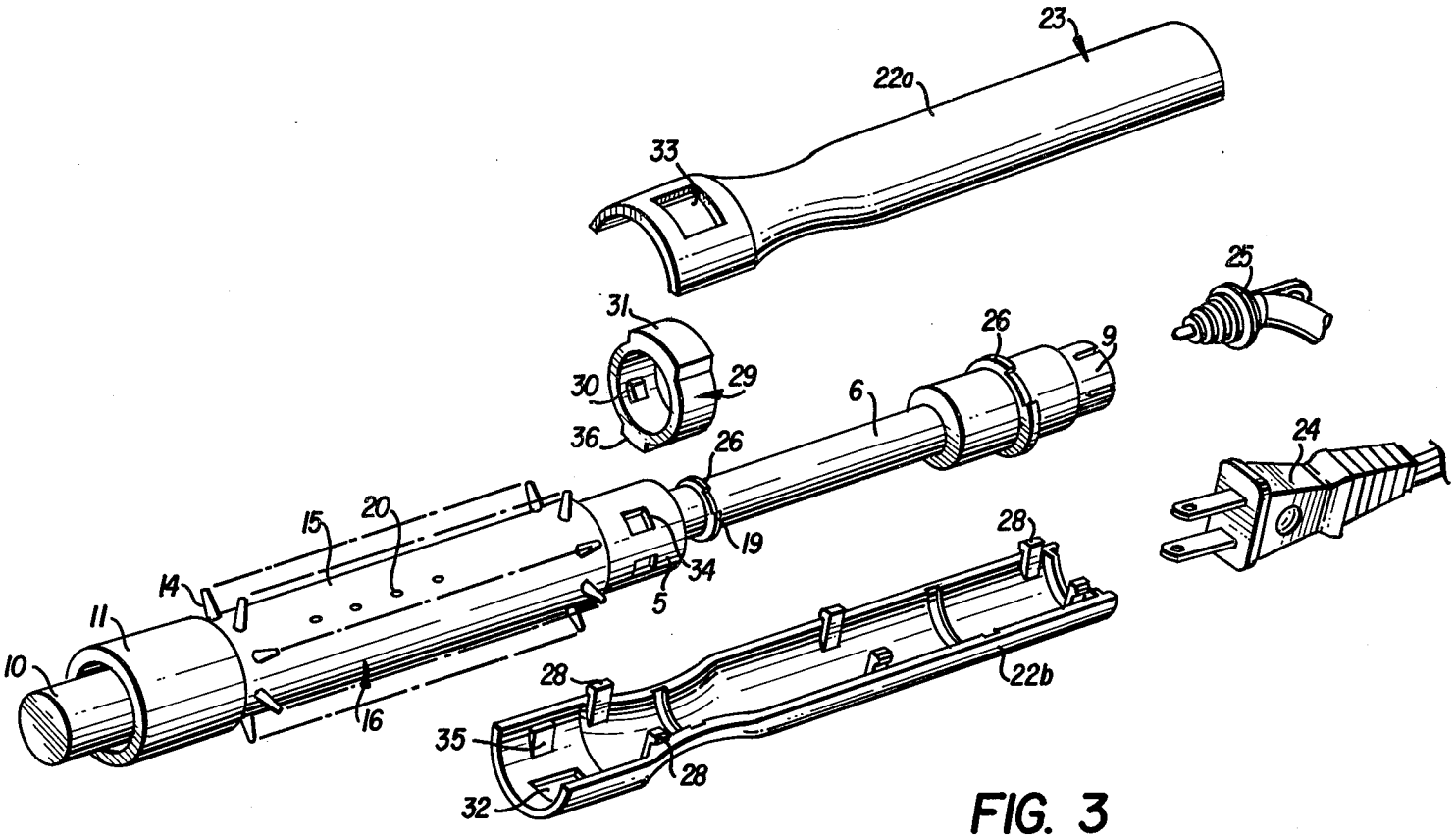
FIG. 3 is a partly exploded perspective view of the same embodiment.
Figure 4:
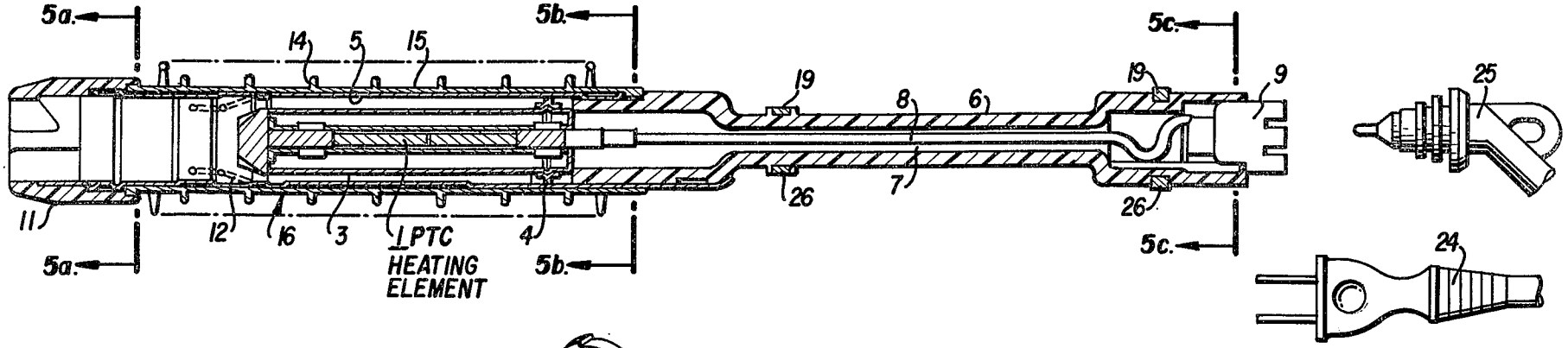
FIG. 4 is a sectional view of the brush cylinder and the brush support.

Fins 4 protrude from the outer circumferential surface of this sleeve and extend longitudinally therealong. The sleeve 3 and the heater 1 are incorporated into a metal pipe 5 by squeezing the fins 4 of the sleeve 3 into the metal pipe 5. The end of a cylindrical support 6, made of a thermal nonconductor, is then inserted into the metal pipe 5 at the rear of the sleeve 3 and the rear end of the metal pipe 5 is adhesively secured to the support 6, thereby forming an integral assembly, as shown in FIGS. 3 and 4. (The term "thermal non-conductor" of course has reference to a material having excellent heat insulating properties). Lead wires 8 are passed through a through-hole 7 inside the support 6 and are electrically connected, such as by soldering, to a connection block 9 located at the rear end of the support 6. A stop ring 11 and a water storage retaining tank 10 are press-fitted onto the distal end of the metal pipe 5 so that the tank 10 is slidably held on that end of the metal pipe 5. A spring 12, is between a water absorber 13 (at the rear, inside the tank 10) and the end of the sleeve 3 to bias them apart. The outer peripheral surface of the metal pipe 5 is covered by a bristle cylinder 15 having a plurality of comb teeth 14 projecting radially therefrom, the metal pipe 5 and the bristle cylinder 15 comprising a brush cylinder 16. The bristle cylinder 15 is prevented from rotating about the metal pipe 5, etc., by protrusions and recesses as shown in FIG. 5(*a*) and (*b*), while play in the axial direction is prevented by protrusions 17 at both ends which engage with square holes 18 in the stop ring 11, etc.

Figure 6:
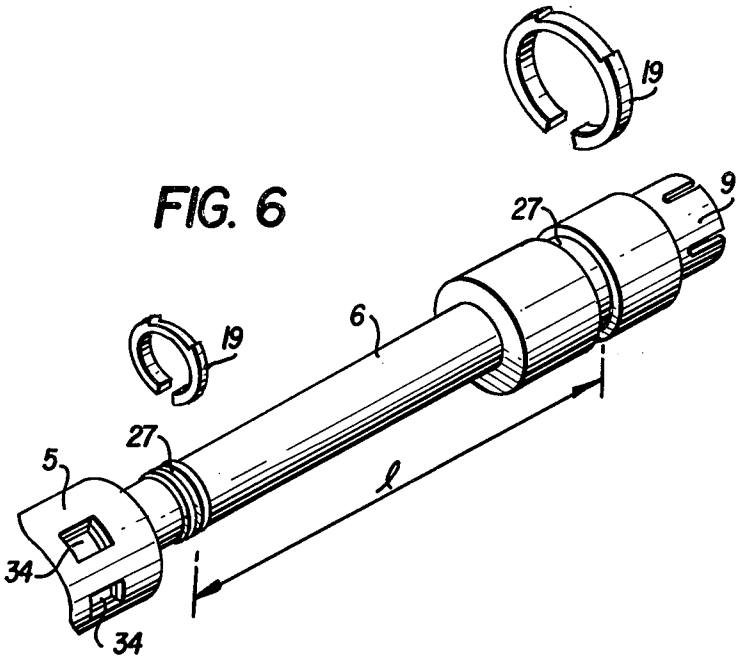
FIG. 6 is an exploded perspective view of the support showing the bearing rings and the grooves into which they are fitted.

Reference numeral 19 identifies a bearing ring which has one part cut out, and another is reduced in thickness (approximately C-shaped). As shown in FIG. 6, two bearing rings 19 are rotatably fitted in grooves 27 on the peripheral surface at both ends of the support 6 at an axial distance l from each other which is approximately equal to the width of a hand (FIGS. 1 and 6). Numeral 20 indicates one of a series of steam-ejection holes and 21 identifies a temperature-indication tape. A generally cylindrical handle 23 comprises a pair of half-cylinders 22*a* and 22*b* which hold the support 6 from both sides so that the support 6 is rotatably mounted within the handle 23. The half-cylinders 22*a* and 22*b* are secured together by means of engagement hooks 28, and the support 6 is rotatably held inside the handle 23 by a bearing surface 26 on the outside of the bearing rings 19. A rotary connector 25 at the end of a power supply cord 24 is inserted in the rear end of the handle 23 and fixed therein so that the connection block 9 at the end of the support 6 is electrically coupled to the rotary connector 25. The connection block 9 end of the rotary connector 25 is designed to be conductive even when being rotated. As described above, the brush cylinder 16 is secured to the support 6 and the support 6 is rotatably mounted inside the handle, so that the mechanism for rotating the brush cylinder 16 is not located inside the brush cylinder 16, but is instead inside the handle 23, resulting in a simplified structure of the brush cylinder 16 and an improved thermal conduction efficiency from the heater 1 to the surface of the brush cylinder 16. Since the support 6 is rotatably mounted on the bearing surfaces 26 inside the handle 23 and the distance l between the bearing surfaces 26 is approximately equal to the width of a hand, the force applied to the handle 23 when grasped by a hand is borne by the support 6 through the bearings 26. This construction minimizes the stress tending to separate the handle parts so that no gaps will be produced between the half-cylinders 22*a* and 22*b* due to the force applied by grasping the handle 23, thus permitting stable rotation of the support 6 and brush cylinder 16. Moreover, because the support 6 is made of a thermal nonconductor, a minimum amount of heat from the heater 1 is conducted to the bearings and handle 23 thus assuring the long life of the bearings and a low temperature of the handle 23. As the brush cylinder 16 rotates, the plug 9 of the rotary connector 25 is free to rotate, thereby ensuring that the lead wires 8 will not be twisted inside the brush cylinder 16 and the support 6. Therefore, no force will be imposed on the support 6 from the lead wires 8, permitting smooth rotation of the brush cylinder 16.

Figure 7:
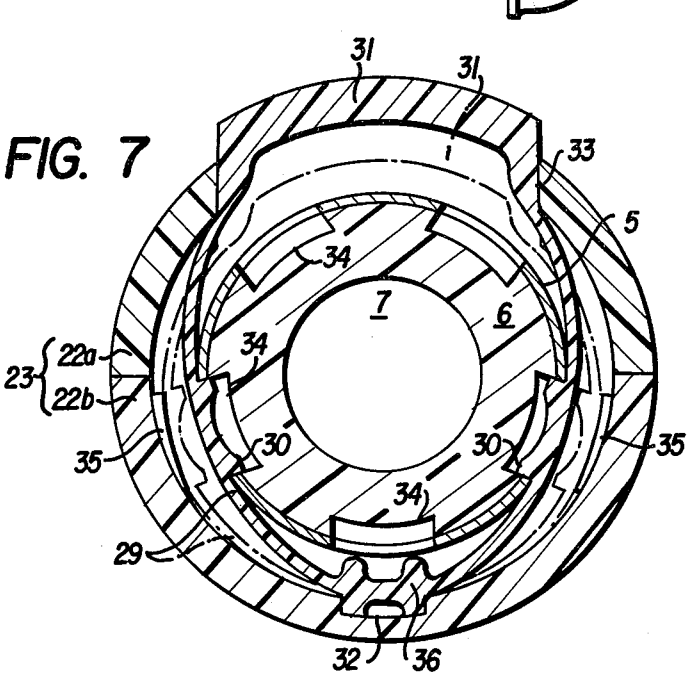
FIG. 7 is a sectional view showing the operation of the detent means utilizing a locking ring.

Numeral 29 indicates an elastically deformable locking ring which has a thin elliptical shape, of a larger interior diameter than the outer diameter of support 6 which passes through it and has protrusions 30 on its inner circumferential surface on the minor axis side, while an operating pushbutton 31 protrudes from the outer circumferential surface on the major axis, and a stopper protrusion 36 is positioned on the outer surface diametrically opposite to this operating pushbutton 31. This locking ring 29 is housed in handle 23 and is prevented from rotating by fitting stopper protrusion 36 into a recess 32 on the inner circumferential surface of handle 23 and operating pushbutton 32 projects through a slot 33 in the handle 23. The support 6 passes through the locking ring 29 and to secure them together, a plurality of slots 34 are formed in metal pipe 5 and support 6 to correspond to protrusions 30 of locking ring 29 and, as shown by the solid lines in FIG. 7, because of the elasticity of locking ring 29, the protrusions 30 fit into the slots 34 to prevent mutual rotation between brush cylinder 16 and support 6. When the operating pushbutton 31 is pushed radially inwardly from above the handle 23 toward the support 6, as shown by the broken lines in FIG. 7, the locking ring 29 deforms elastically, causing the protrusions 30 to escape from slots 34, thereby allowing the free rotation of brush cylinder 16 and support 6, and when operating pushbutton 31 is released locking ring 29 returns elastically to its former position, again locking the brush cylinder 16. Stoppers 35 prevent the over-deflection of the locking ring 29.

Accordingly, it is possible to wind hair around the peripheral surface of the brush cylinder 16 while the brush cylinder 16 is rotationally locked in relation to handle 23, and impart a curl to the hair by heating it by the heater 1 and, when water absorber 13 is brought into contact with the end of the sleeve 3 by pushing in the end of the tank 10, steam can be generated, enabling a stronger curl to be imparted to the hair. The wound hair can be unwound by depressing the operating pushbutton 31 to unlock the brush cylinder and then pulling out the hair curler so that the brush cylinder can rotate freely, allowing the hair to be readily unwound without entanglement. It should be appreciated that the detent is composed of the locking ring 29 to simplify the structure and reduce the length of this part.

According to this invention, as described above, a brush cylinder is mounted on the end of a support 6 which is integral therewith and in axial alignment with the support, a heater is housed in this brush cylinder and the support is rotatably housed inside a substantially cylindrical handle. In this way, the need for rotatably supporting the brush cylinder, which would otherwise be required, between the heater and the brush cylinder of a brushholding pipe is obviated. Accordingly, while unwinding of the hair is simply accomplished without any entanglement simply by freeing the brush cylinder to allow it to rotate, a more efficient conduction of heat from the heater to the brush cylinder, and thus an increased hair-curling ability can be obtained without blocking the heat conduction from the heater to the brush cylinder, or unnecessarily increasing the distance between the brush cylinder and the heater.

What is claimed is:

1. A rotating brush cylinder hair curler comprising:
a generally cylindrical elongated handle;
an elongated brush support rotatably mounted within said handle and axially extending therefrom;
a brush cylinder non-rotatably mounted on the axial extension of said brush support;
an electric heating means housed within said brush cylinder;
means for locking the brush cylinder and handle to prevent rotation therebetween, comprising:
an elastically deformable eliptical ring surrounding the brush support and housed within the handle, said ring having at least one first engagement means on its inner surface;
at least one corresponding second engagement means on the confronting surface of the brush support portion within said eliptical ring and normally engaged with said first engagement means;
means selectively operable for deforming said eliptical ring toward a circular shape so as to disengage said first and second engagement means so as to permit the handle to rotate freely in relation to the brush cylinder and brush support.

2. The hair curler of claim 1 in which the elongated brush support has an axial bore therethrough for housing lead wires for the electric heating means.

3. The hair curler of claim 1 in which the handle is formed of a pair of semi-cylindrical members and the elongated brush support is rotatably mounted within the handle by at least two bearing, the axial distance between said bearings being approximately the width of a human hand.

4. The hair curler of claim 1 in which the elongated brush support is made of a thermal nonconductor.

5. The hair curler of claim 2 including a connection block at the end of the elongated brush support within the handle and electrically connected to said lead wires; rotary connection means on said connection block for rotary attachment of an electric supply cord thereto.

6. A rotating brush cylinder hair curler comprising:
a generally cylindrical elongated handle;
an elongated brush support rotatably mounted within said handle and axially extending therefrom;
a brush cylinder non-rotatably mounted on the axial extension of said brush support;
an electric heating means housed within said brush cylinder;
means for locking the brush cylinder and handle to prevent rotation therebetween, comprising:
an elastically deformable eliptical ring surrounding the brush support and housed within the handle, said ring having at least one protrusion along the inner surface of one of its long sides;
at least one recess in the confronting surface of the brush support portion within said eliptical ring, said protrusion normally engaging said recess;
a manually depressible release button on one of the short sides of said locking ring and projecting through an opening in said handle;

a space radially outwardly of the long sides of said eliptical locking ring so that upon depression of said release button at least one long side will deflect radially outwardly to disengage said protrusion from said recess and said protrusion will return to said recess due to the elasticity of the ring, upon release of said button.

7. The hair curler of claim 6, in which the elongated brush support has an axial bore therethrough for housing lead wires for the electric heating means.

8. The hair curler of claim 6, in which the handle is formed of a pair of semi-cylindrical members and the elongated brush support is rotatably mounted within the handle by at least two bearing, the axial distance between said bearings being approximately the width of a human hand.

9. The hair curler of claim 6, in which the elongated brush support is made of a thermal nonconductor.

10. The hair curler of claim 6, including a connection block at the end of the elongated brush support within the handle and electrically connected to said lead wires; rotary connection means on said connection block for rotary attachment of an electric supply cord thereto.

* * * * *